US007242886B2

(12) United States Patent
Takei

(10) Patent No.: US 7,242,886 B2
(45) Date of Patent: Jul. 10, 2007

(54) RESIDUAL TONER REMOVAL APPARATUS AND IMAGE FORMING APPARATUS

(75) Inventor: Yuhei Takei, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 218 days.

(21) Appl. No.: 11/109,721

(22) Filed: Apr. 20, 2005

(65) Prior Publication Data

US 2005/0238382 A1 Oct. 27, 2005

(30) Foreign Application Priority Data

Apr. 27, 2004 (JP) ..... 2004-131473

(51) Int. Cl.
*G03G 15/16* (2006.01)

(52) U.S. Cl. ..... 399/101

(58) Field of Classification Search ..... 399/66, 399/101, 121, 297, 302
See application file for complete search history.

(56) References Cited

U.S. PATENT DOCUMENTS 5,963,769 A 10/1999 Emukai et al. ..... 399/297

FOREIGN PATENT DOCUMENTS

JP 07199603 A * 8/1995
JP 11-52757 2/1999
JP 2000075571 A * 3/2000
JP 2001-337542 12/2001

* cited by examiner

*Primary Examiner*—David M. Gray
*Assistant Examiner*—Ryan Gleitz
(74) *Attorney, Agent, or Firm*—Fitzpatrick, Cella, Harper & Scinto

(57) ABSTRACT

An image forming apparatus according to the present invention includes an image bearing member, toner image forming device for forming a toner image on the image bearing member, a transferring member for bringing into and out of contact with the image bearing member by rocking operation to electrostatically transfer the toner image on the image bearing member to a transfer material, and a toner removing device for, while the transferring member rocks, electrostatically removing the toner on the transferring member by that a bias is applied.

2 Claims, 9 Drawing Sheets

FIG. 8
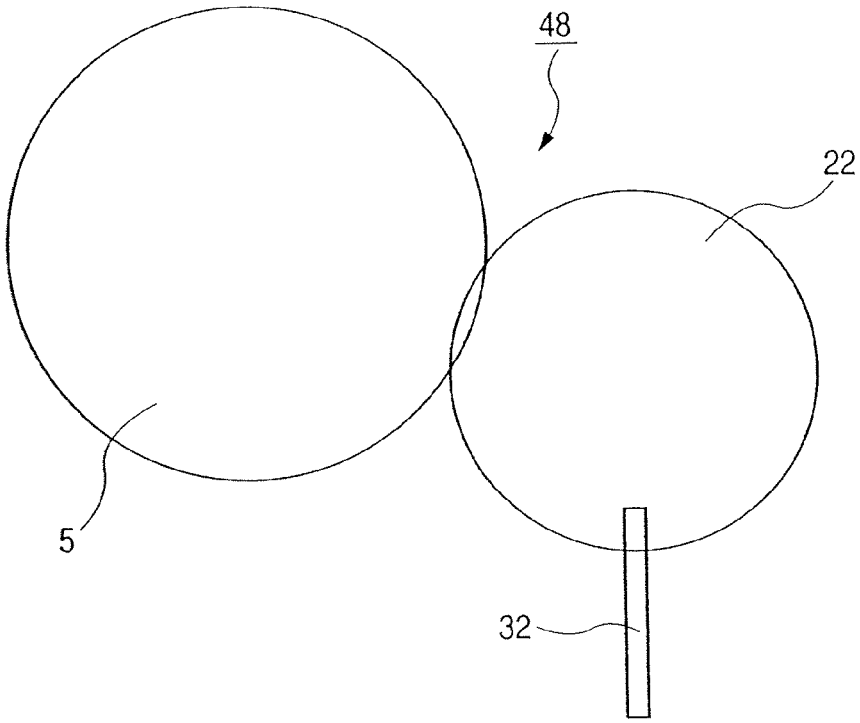
PRIOR ART FIG. 9
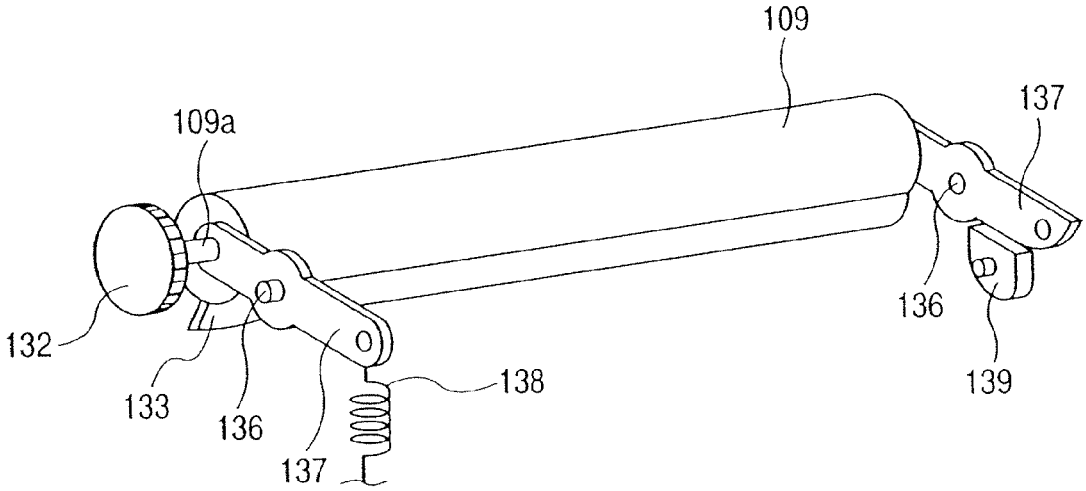

RESIDUAL TONER REMOVAL APPARATUS AND IMAGE FORMING APPARATUS

BACKGROUND OF THE INVENTION

1. Field of the Invention

The present invention relates to a residual toner removal apparatus for removing residual toner adhering to a transferring rotary member for transferring a toner image to a transfer material, and an image forming apparatus equipped with the residual toner removal apparatus.

2. Related Background Art

In conventional image forming apparatuses, there is known an image forming apparatus in which a transfer material (e.g., a sheet) is held between an intermediate transferring member having a toner image formed thereon through primary transferring, and a secondary transferring member capable of being brought into and out of contact with the intermediate transferring member, and secondary transferring of the toner image on the intermediate transferring member to the transfer material is effected (see Japanese Patent Application Laid-Open No. 11-52757). FIG. 9 is a perspective view of a secondary transferring roller pushing mechanism of the image forming apparatus. FIG. 10 is a front view of a main portion of an image transferring apparatus.

A shaft 109*a* of a secondary transferring roller 109 as a secondary transferring rotary member is rotatably supported at one end of each of arms 137 adapted to rock around rotation shafts 136. The secondary transferring roller 109 rotates integrally with a driven gear 132 coaxial with the shaft 109*a*. The arms 137 are biased so as to rotate clockwise as seen in the drawing by a spring 138 provided at the other end of one of the arms 137. The secondary transferring roller 109 is pushed against a transfer belt 107 as an intermediate transferring member by the pulling force of the spring 138. The rotation shafts 136 of the arms 137 are shafts common to a shaft 134 of a driving gear 131 or are at least arranged coaxially therewith. At the other end of one of the arms 137, an eccentric cam 139 is arranged so as to be opposed to the arm. The arm 137 is pushed against the cam surface of the eccentric cam 139 by the pulling force of the spring 138.

In this construction, when a flat portion 139*a* of the eccentric cam 139 is opposed to the arm 137, the arms 137 are pulled by the spring 138 to rotate clockwise, bringing the secondary transferring roller 109 into press contact with the transfer belt 107. When, in this state, the driving gear 131 rotates, the secondary transferring roller 109 is caused to rotate through the driven gear 132. When a transfer material (e.g., a sheet) enters the gap between the rotating secondary transferring roller 109 and the running transfer belt 107, a toner image on the transfer belt 107 is transferred to the transfer material.

When the eccentric cam 139 rotates and its maximum radius portion 139*b* comes into contact with the arm 137, the arm 137 rotates counterclockwise against the force of the spring 138, separating the secondary transferring roller 109 from the transfer belt 107. The driving gear 131 and the driven gear 132 are constantly in mesh with each other regardless of whether the secondary transferring roller 109 is separated from the transfer belt 107 or is contacted with the transfer belt 107. Residual toner on the transfer belt 107 may adhere to the secondary transferring roller 109. Thus, when it is at a position where it is in contact with the transfer belt 107, the secondary transferring roller 109 is also in contact with a cleaning blade 133, by means of which the residual toner is removed.

In some image forming apparatuses, the residual toner adhering to the transfer belt as the intermediate transferring member is removed by electrostatic cleaning (see Japanese Patent Application Laid-Open No. 2001-337542). FIG. 11 is a schematic front view of a cleaning device 213 of such an image forming apparatus.

The cleaning device 213 forms a cleaning area in a part of a portion where an intermediate transfer belt 207A is in contact with a roller 207B as an opposing roller. The cleaning device 213 is equipped with a first bias roller 224, a first fur brush 223 in contact with the first bias roller 224, a second bias roller 227, a second fur brush 226 in contact with the second bias roller 227, a carrying screw 229, etc. By applying a bias voltage of reverse polarity to the first fur brush 223 and the second fur brush 226, cleaning of the intermediate transfer belt 207A is effected.

In this way, in the conventional image forming apparatuses, it is possible to remove residual toner adhering to the secondary transferring roller and the transfer belt. However, the residual toner adhering to the secondary transferring roller 109 is mechanically removed by the cleaning blade 133. Thus, there is a fear of the secondary transferring roller being damaged. Further, the residual toner is removed by the cleaning blade 133 only when the secondary transferring roller 109 is at the position where it is in contact with the transfer belt 107, resulting in a rather low residual toner removal efficiency.

When the residual toner removal efficiency is low, some residual toner is allowed to adhere to the transfer material, which leads to a deterioration in image quality.

SUMMARY OF THE INVENTION

It is an object of the present invention to provide a residual toner removal apparatus which is constantly capable of electrostatically removing residual toner adhering to the secondary transferring rotary member.

Another object of the present invention is to provide an image forming apparatus equipped with a residual toner removal apparatus constantly effecting electrostatic removal, thereby achieving an improvement in the quality of the image on the transfer material.

To attain the above objects, according to the present invention, there is provided an image forming apparatus including an image bearing member, toner image forming device for forming a toner image on the image bearing member, a transferring member for bringing into and out of contact with the image bearing member by rocking operation to electrostatically transfer the toner image on the image bearing member to a transfer material, and a toner removing device for, while the transferring member rocks, electrostatically removing the toner on the transferring member by that a bias is applied.

In the residual toner removal apparatus of the present invention, the toner collection rotary member is arranged such that its rotation center coincides with the rotation center of the rotary member, so that even if the toner collection rotary member is rocked using the toner collection rotary member to which a bias voltage of a polarity reverse to that of the residual toner as the fulcrum, it is possible to apply a bias voltage to the toner collection rotary member, making it possible to constantly remove the residual toner.

Further, since residual toner is removed electrostatically, it is possible to remove the residual toner with less damage to the toner collection rotary member than in the prior art.

Further, since a bias voltage of reverse polarity is applied to the toner collection rotary member that does not move, it is possible to simplify the drive construction for rotating the toner collection rotary member, whereby it is possible to achieve space saving for the image transferring apparatus and to achieve a reduction in cost; this also proves effective in achieving a reduction in the torque required for effecting the rocking movement.

The image forming apparatus of the present invention is equipped with the residual toner removal apparatus which constantly removes residual toner electrostatically, whereby it is possible to achieve an improvement in terms of the quality of the image on the transfer material.

BRIEF DESCRIPTION OF THE DRAWINGS

FIGS. 7A, 7B, 7C and 7D are diagrams for illustrating the operation of the residual toner removal apparatus, of which FIG. 7A is a diagram showing a state in which residual toner adheres to the secondary transferring outer roller, FIG. 7B is a diagram showing a state in which the residual toner is collected by a fur, FIG. 7C is a diagram showing a state in which the residual toner is collected by the electrostatic roller, and FIG. 7D is a diagram showing a state in which the residual toner is scraped off by a scraping member;

FIG. 8 is a front view of a residual toner removal apparatus according to another embodiment;

FIG. 9 is a perspective view of a secondary transferring roller pushing mechanism of a conventional image forming apparatus;

DESCRIPTION OF THE PREFERRED EMBODIMENTS

In the following a residual toner removal apparatus according to an embodiment of the present invention and an image forming apparatus equipped with this residual toner removal apparatus will be described.

Figure 1:
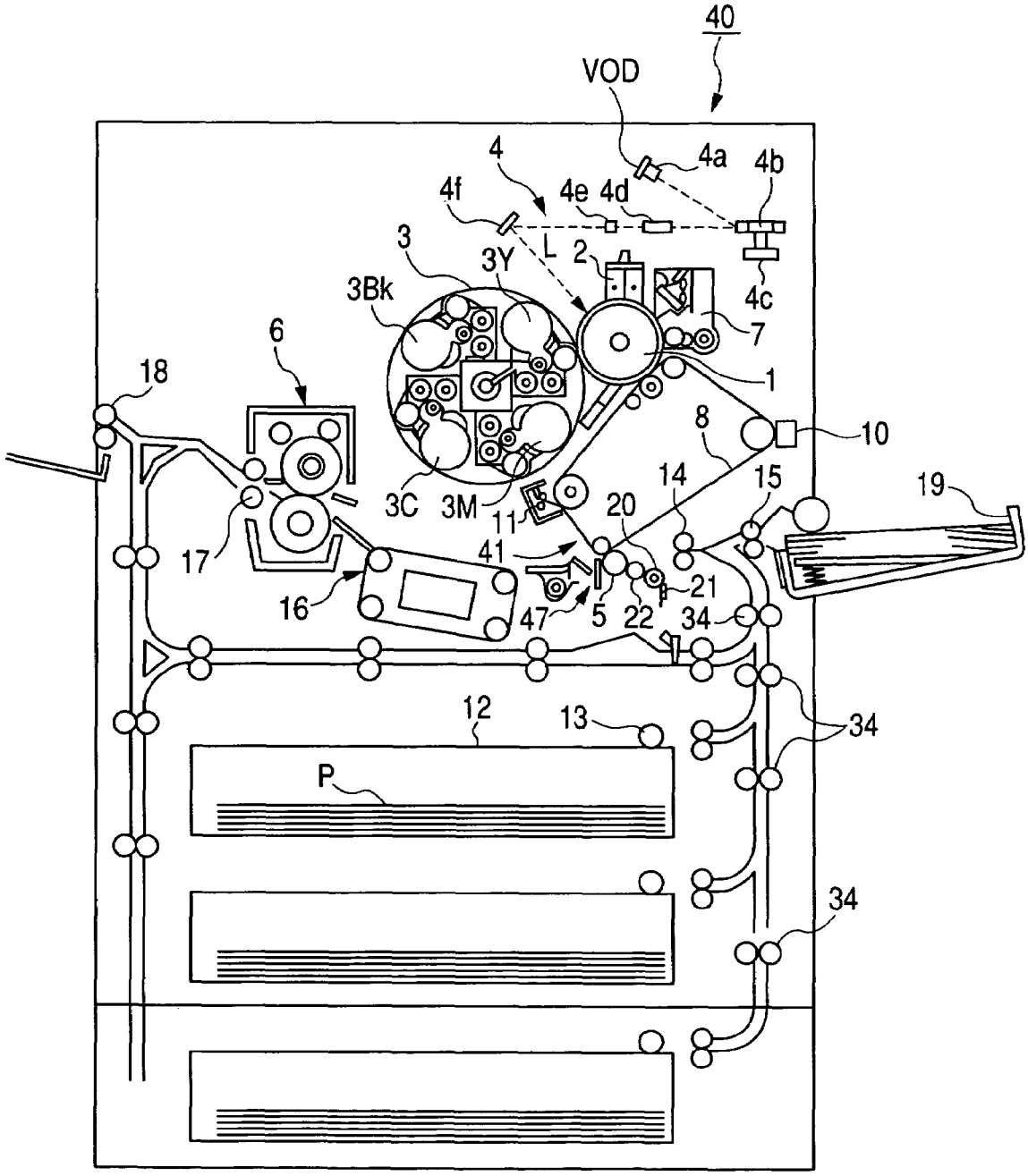
FIG. 1 is a schematic front sectional view of a color laser printer constituting an image forming apparatus according to an embodiment of the present invention.

FIG. 1 is a sectional view of an image forming apparatus according to an embodiment of the present invention taken along the direction in which a transfer material is conveyed. While in this embodiment the image forming apparatus is a color laser printer (hereinafter simply referred to as the printer) 40, this should not be construed restrictively.

In the printer 40, toner images of yellow, magenta, cyan, and black are successively formed one by one on a photosensitive drum 1, which is an image bearing member consisting of a drum-shaped electrophotographic photosensitive member (photosensitive member). The toner images of different colors on the photosensitive drum 1 are repeatedly transferred one by one to an intermediate transfer belt 8 as an intermediate transferring member to thereby form, for example, a full color toner image on the intermediate transfer belt 8. Thereafter, the full color toner image is collectively transferred to a transfer material by a secondary transferring outer roller 5 as a secondary transferring rotary member, and is then fixed to thereby obtain a permanent image.

The printer 40 has the photosensitive drum 1 substantially at its center. When image forming operation is started, the printer 40 charges the surface of the photosensitive drum 1 to a predetermined polarity and a predetermined voltage level by means of a charging roller 2.

Next, a detector 10 detects the beginning position of the image, which is determined by taking into account the transfer position when the toner images on the photosensitive drum 1 are transferred to the intermediate transferring belt 8. In synchronism with a reference signal (TOP signal) from the detector 10, exposure scanning is performed on the photosensitive drum 1 with a laser beam L modulated by an image signal (VDO signal), whereby, first, an electrostatic latent image corresponding to the image signal of the first color is formed on the photosensitive drum 1. At this time, a photo detector 4*e* detects a signal (BD signal) indicating the horizontal exposure scanning start point, whereby exposing in synchronism with the BD signal is effected.

Here, an exposing system 4 is composed of a laser unit 4*a* emitting the laser beam L, a polygon mirror 4*b* for effecting horizontal scanning with the laser beam L, a scanner motor 4*c* for rotating the polygon mirror 4*b* at low speed, an fθ lens 4*d* for effecting image formation with the laser beam L, the above-mentioned photo detector 4*e* for detecting the BD signal indicating the horizontal scanning start point, a reflection mirror 4*f* for guiding the laser beam L to the photosensitive drum, and the like. The laser beam L is on/off-modulated by the above-mentioned image signal (VDO signal), which is an input signal of the laser unit 4*a*.

A rotary type developing member 3 is equipped with developing devices 3Y, 3M, 3C, and 3B*k* respectively containing yellow, magenta, cyan, and black developers. The rotary type developing member 3 rotates with a predetermined timing, causing the developing devices (3Y, 3M, 3C, and 3B*k*) to face the photosensitive drum 1. First, to develop the electrostatic latent image of the first color, the rotary type developing member 3 rotates and causes the yellow developing device 3Y to face the photosensitive drum 1, forming a toner image in the first color, i.e., an yellow toner image, on the photosensitive drum 1. The photosensitive drum 1 and the rotary type developing member 3 constitute an image forming portion.

Thereafter, the yellow toner image on the photosensitive-drum 1 is transferred to the intermediate transfer belt 8 by applying a transfer bias voltage of a polarity reverse to that of the toner to the intermediate transfer belt 8.

Similar processes described above are repeatedly conducted for the second, third, and fourth colors, i.e., magenta, cyan, and black, whereby, for example, a full color toner image is transferred to the intermediate transfer belt 8 (primary transferring).

Further, with a predetermined timing based on the reference signal (TOP signal) from the detector 10, a paper feed roller 13 supplies a transfer material P accommodated in a paper feed cassette 12 into the image forming apparatus.

The transfer material P is conveyed by conveying rollers 34 to registration rollers 14 for controlling the timing with which the toner image is transferred to the transfer material P, and is temporarily stopped there. Then, in synchronism with the predetermined transfer timing, the transfer material P is sent from the registration rollers 14 into the gap between the intermediate transfer belt 8 and the transfer roller 5 (hereinafter referred to as the "secondary transferring outer roller"). The full color toner image on the intermediate transfer belt 8 is transferred electrostatically and collectively to the transfer material P by the transfer roller 5 (secondary transferring).

The transfer material P bearing the unfixed full color toner image is conveyed to a fixing device 6 by a conveying belt unit 16. The unfixed full color toner image is fused to the transfer material P by the heat and pressure of the fixing device 6 to become a permanent image. Thereafter, the transfer material P is discharged to the exterior of the image forming apparatus 40 by conveying rollers 17 and 18.

Transfer residual toner (residual toner) remaining on the photosensitive drum 1 after the completion of the image transfer (for each color) to the intermediate transfer belt 8, residual toner remaining on the surface of the intermediate transfer belt 8 after the completion of the transfer of the full color toner image to the transfer material P, or the like is removed by cleaning devices 7 and 11 each having a blade-like cleaning member. As a result, the photosensitive drum 1 and the intermediate transfer belt 8 perform image formation on the transfer material in a clean state. Also, by means of a multi-paper-feed tray 19 and a paper feed roller 15 for the multi-paper-feed tray, a plurality of kinds of transfer material P can be supplied.

In the above-described construction, the secondary transferring outer roller 5, which transfers the toner on the intermediate transfer belt 8 to the transfer material, forms a secondary transferring portion 41 as an image transferring apparatus.

Figure 2:
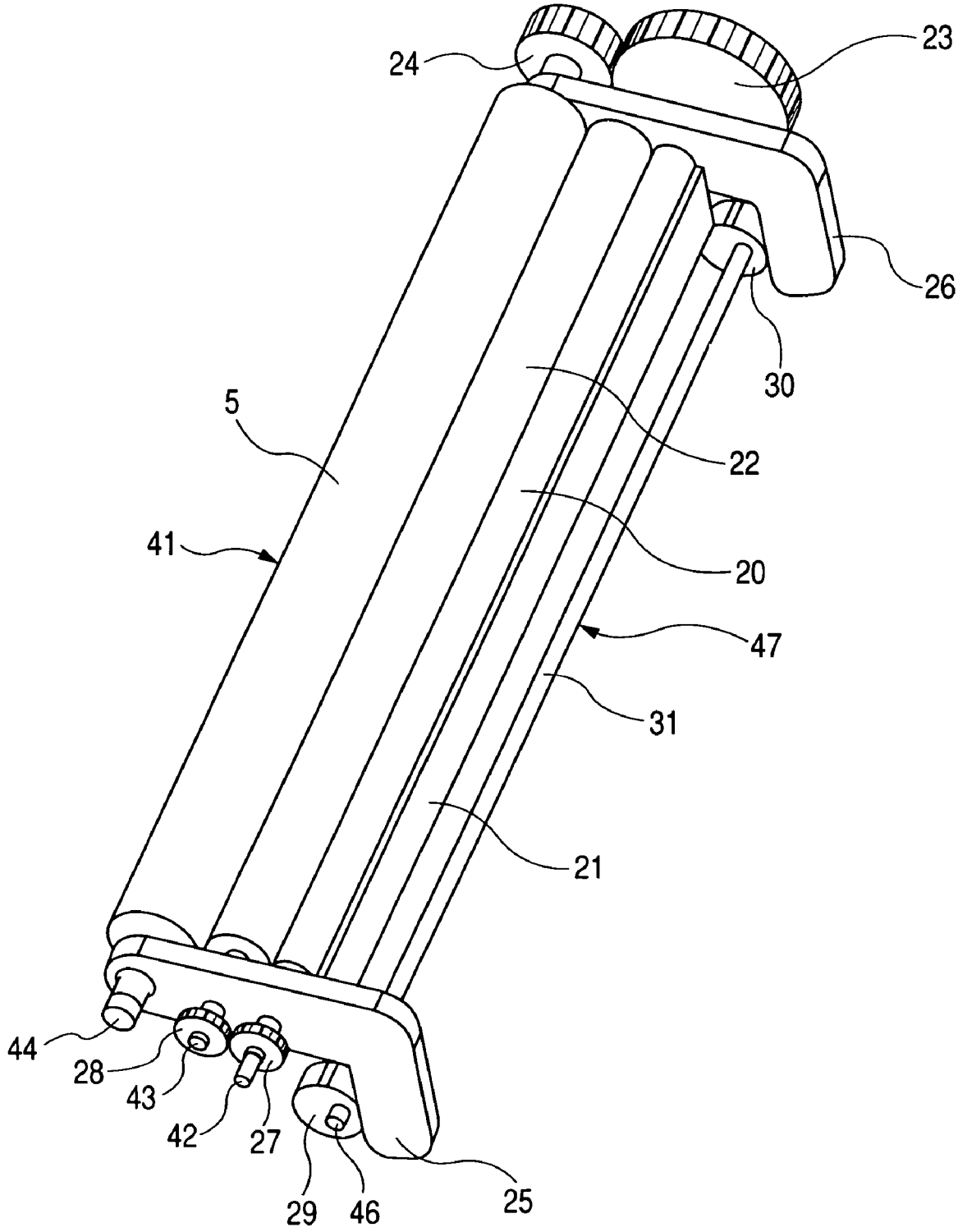
FIG. 2 is a perspective view of a secondary transferring portion as an image transferring apparatus.
Figure 3:
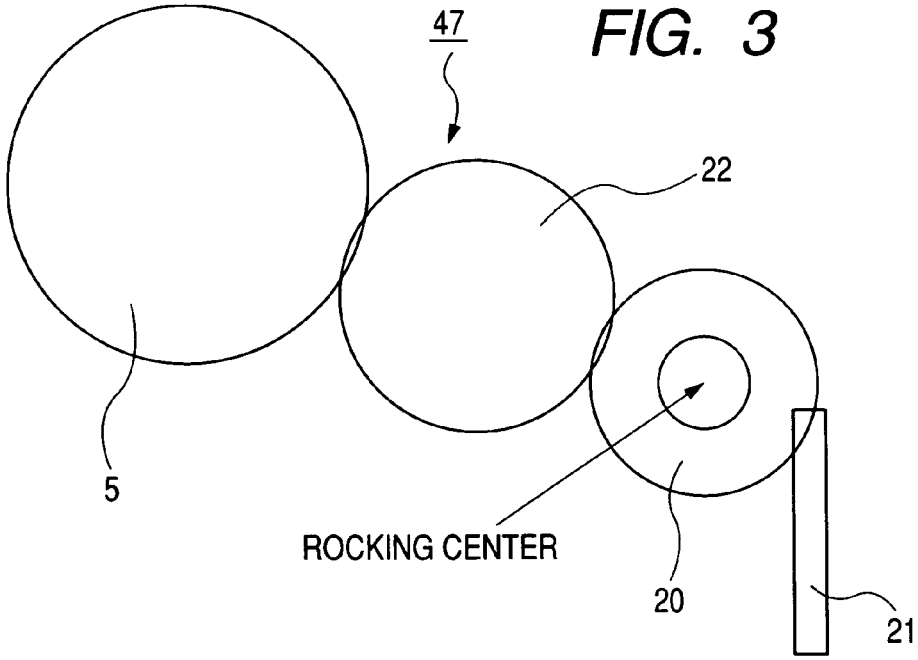
FIG. 3 is a schematic front view of the secondary transferring portion as an image transferring apparatus.
Figure 4:
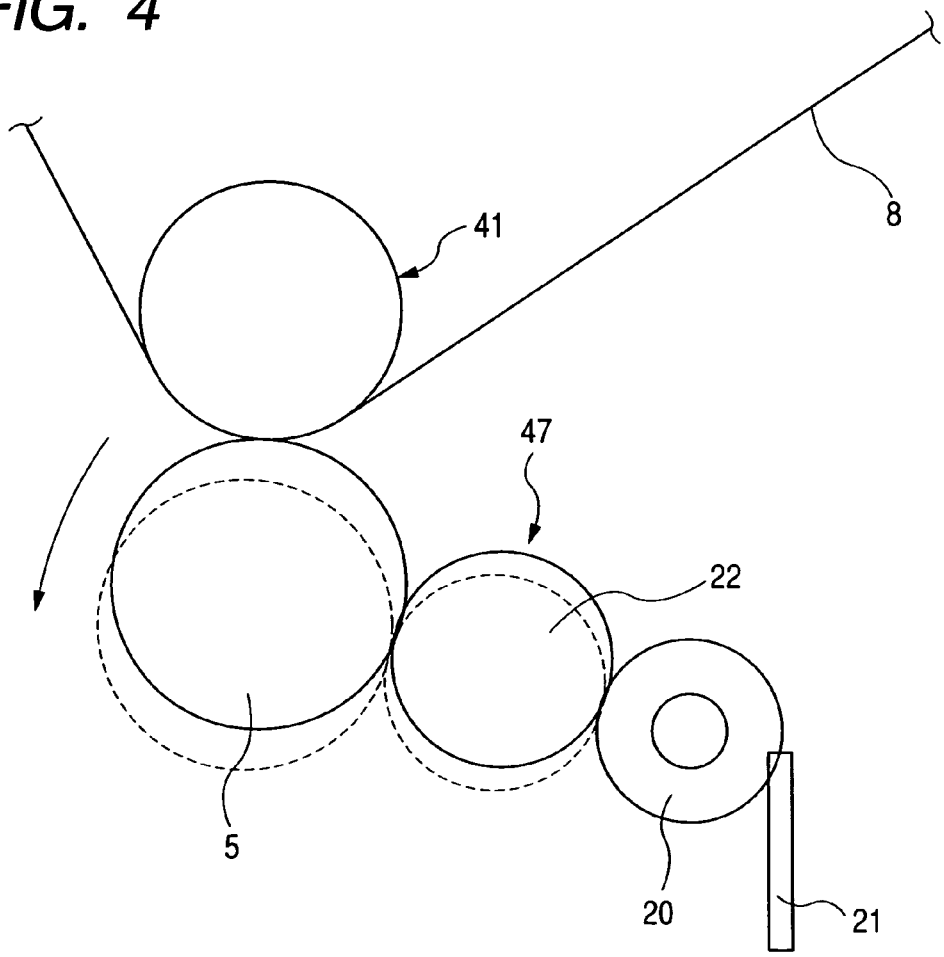
FIG. 4 is a diagram for illustrating how a secondary transferring outer roller is brought into and out of contact with an intermediate transfer belt.

Next, a residual toner removal apparatus 47 according to this embodiment will be described with reference to FIGS. 2 and 3. The residual toner removal apparatus 47 is mainly composed of a fur brush 22 for collecting toner on the secondary transferring outer roller 5, which transfers a multi-color toner image to the transfer material through secondary transferring, an electrode member. i.e., an electrostatic roller 20 for collecting toner adhering to the fur brush 22, a scraping member 21 for scraping off toner adhering to the electrostatic roller 20, and the like.

The secondary transferring outer roller 5, the fur brush 22, and the electrostatic roller 20 are supported at both ends by rocking arms 25 and 26 formed as rotary members. The rocking arms 25 and 26 rotate using a shaft 42 of the electrostatic roller 20 as the fulcrum. The rocking arms 25 and 26 are in contact with eccentric cams 29 and 30. The eccentric cams 29 and 30 are rotated around a shaft 31 by a motor (not shown). Thus, the rocking arms 25 and 26 are rotated by the eccentric cams 29 and 30, bringing the secondary transferring outer roller 5 to contact with the intermediate transfer belt 8 and to separate from the intermediate transfer belt 8 (in other words, bringing the secondary transferring outer roller 5 into and out of contact with the intermediate transfer belt 8).

Further, at the ends of the shaft 42 of the electrostatic roller 20, a transfer driving gear 23 and a fur driving gear 27 are integrally provided. Integrally provided on a shaft 44 of the secondary transferring outer roller 5 is a transfer driven gear 24 which is in mesh with the transfer driving gear 23. Integrally provided on a shaft 43 of the fur brush 22 is a fur driven gear 28. The shaft 43 of the fur brush 22 is electrically insulated from the other components, and the fur brush 22 is in an electrically floating state.

When the transfer driving gear 23 as the driving rotary member is rotated by a driving motor (not shown), there occurs rotation of the electrostatic roller 20, the fur driving gear 27, the transfer driven gear 24 as the driven rotary member in mesh with the transfer driving gear 23, and the secondary transferring outer roller 5. The transfer driving gear 23 and the transfer driven gear 24 form a torque transmission rotary member row. It is also possible to provide an idle gear between the transfer driving gear 23 and the transfer driven gear 24. Further, instead of the gears, it is also possible to use rollers. The fur driven gear 28, which is in mesh with the fur driving gear 27, also rotates, causing the fur brush 22 to rotate. Thus, when the electrostatic roller 20 rotates, the secondary transferring roller 5 and the fur brush 22 rotate.

When a full color image is to be formed, the secondary transferring outer roller 5 is kept away from the intermediate transfer belt 8 until the unfixed toner image of the final color has been primarily transferred to the intermediate transfer belt 8. While the unfixed toner image of the final color is being primarily transferred to the intermediate transfer belt 8, the secondary transferring outer roller 5 comes into contact with the intermediate transfer belt 8. Then, secondary transferring is effected.

Before the secondary transferring outer roller 5 comes into contact with the intermediate transfer belt 8, the secondary transferring outer roller 5, the fur brush 22, and the electrostatic roller 20 rotate for a predetermined period of time. Further, also after the secondary transferring outer roller 5 is separated from the intermediate transfer belt 8, the secondary transferring outer roller 5, the fur brush 22, and the electrostatic roller 20 rotate for a predetermined period of time. Cleaning is effected on the secondary transferring outer roller 5 not only while it is in contact with the intermediate transfer belt 8 but also during the above-mentioned rotation for a predetermined period of time, thus keeping it in a clean state.

Namely, cleaning for the toner adhering on the secondary transferring outer roller 5 is performed, even while the secondary transferring outer roller 5 and the fur brush 22 rock in order that the secondary transferring outer roller 5 contacts with or separates from the intermediate transfer belt 8.

Next, the cleaning operation for removing residual toner adhering to the secondary transferring outer roller 5 will be described. The toner transferred from the photosensitive drum 1 to the intermediate transfer belt 8 is endowed with a certain polarity, and when a bias voltage is applied to the intermediate transfer belt 8, it is secondarily transferred to the transfer material P electrostatically. In some cases, some toner remains on the intermediate transfer belt 8. For example, any residual toner on the intermediate transfer belt 8 outside the width in the sub scanning direction of the transfer material P is transferred to the secondary transferring outer roller 5. This residual toner is a toner of substantially the same polarity.

Figure 5:
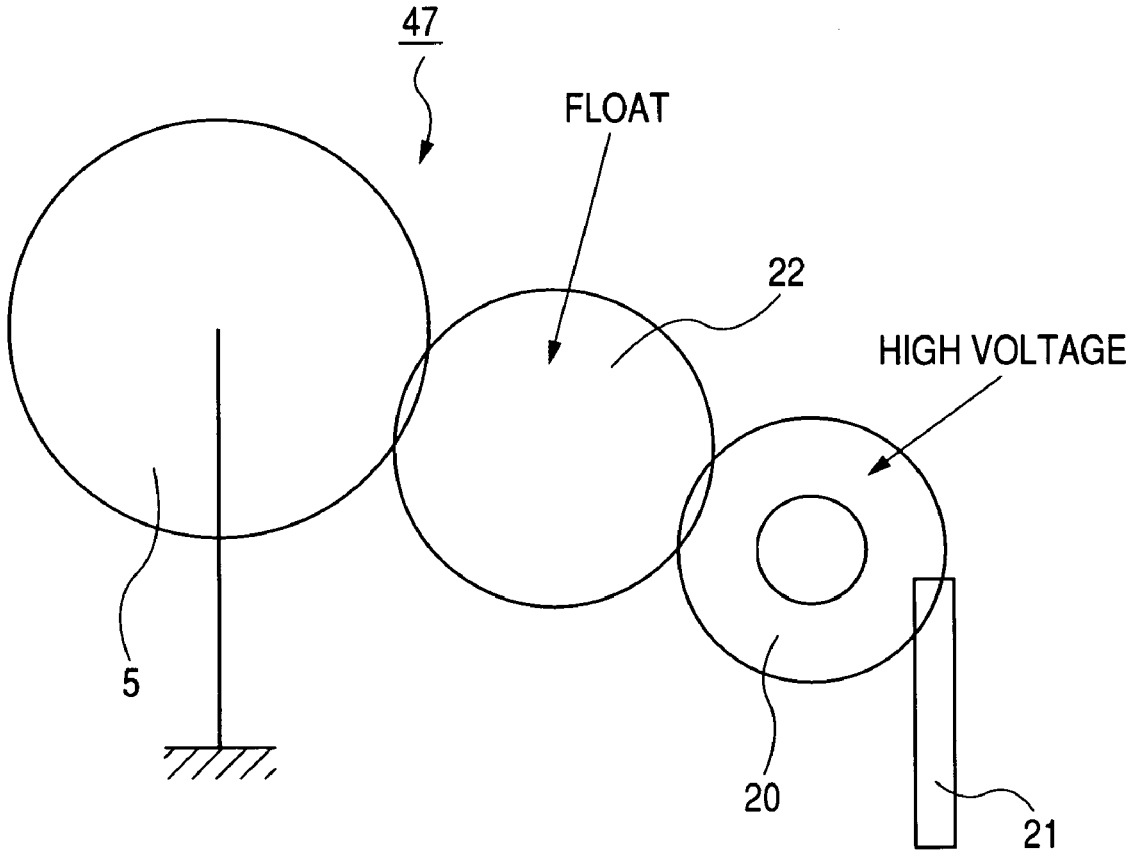
FIG. 5 is a diagram showing an electrical construction of a residual toner removal apparatus.
Figure 6:
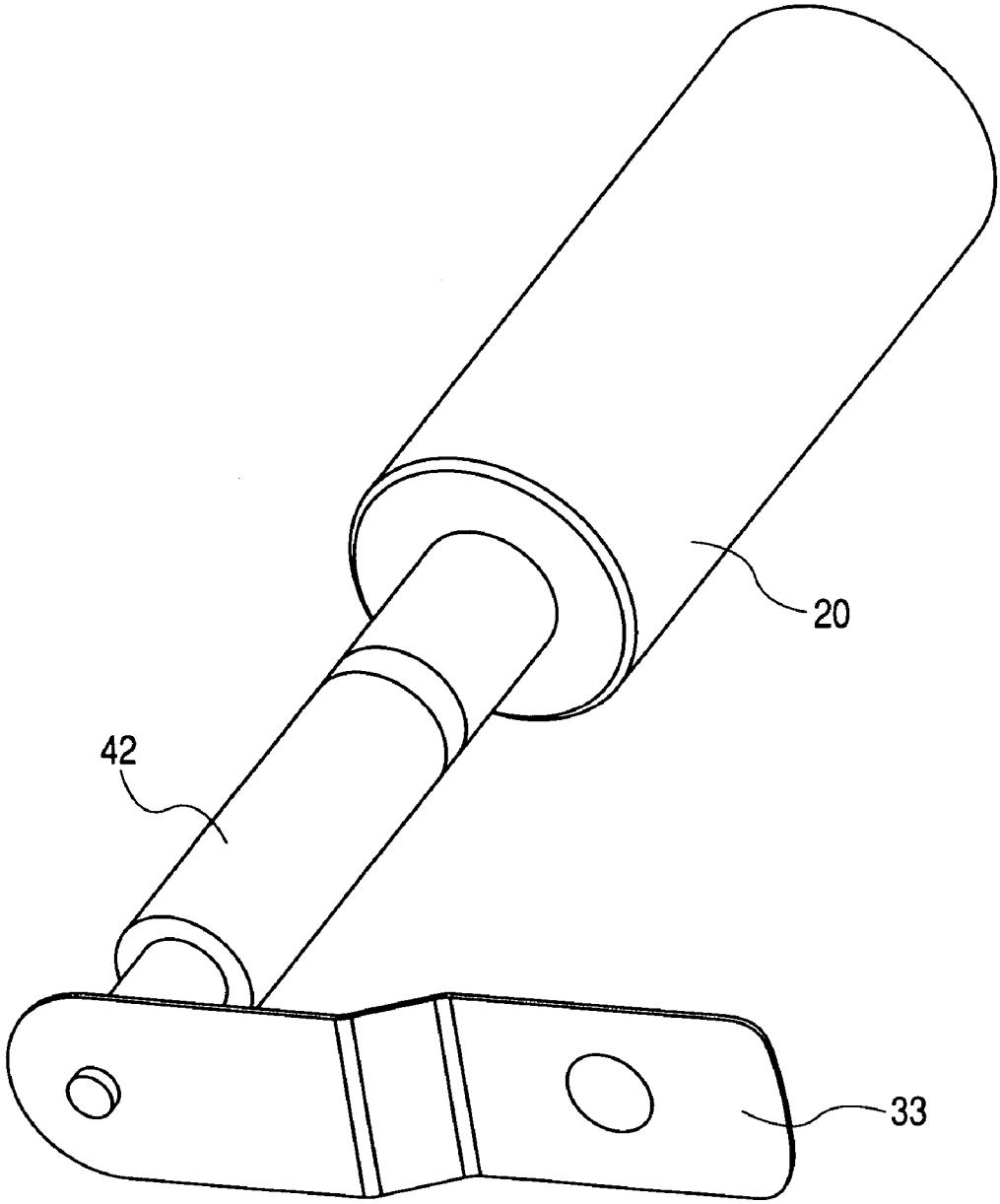
FIG. 6 is a perspective view of a high bias voltage application mechanism of an electrostatic roller.

Here, the electrical layout of the secondary transferring portion will be described with reference to FIG. 5. First, a bias voltage of a polarity reverse to that of the residual toner on the secondary transfeffing outer roller 5 is applied to the electrostatic roller 20 serving as the toner collecting rotary member. The fur brush 22 is in an electrically floating state, and the secondary transferring outer roller 5 is grounded. Here, the secondary transfeffing outer roller 5 rocks using the electrostatic roller 20 as the fulcrum, so that, when high voltage is to be inputted to the electrostatic roller 20, the high voltage can be easily inputted by a plate spring 33 as shown in FIG. 6. The electrostatic roller 20, the fur brush 22, and the like constitute a residual toner removing means.

Further, an electrical relation among the secondary transfeffing outer roller 5, the fur brush 22 and the electrostatic roller 20 in the secondary transfeffing portion does not change even while the secondary transfeffing outer roller 5 and the fur brush 22 integrally rock. Namely, during rocking, the secondary transferring outer roller 5 is grounded, and through the electrostatic roller 20 the secondary transfeffing outer roller 5 and the fur brush 22 are applied by high voltage.

Figure 7A:
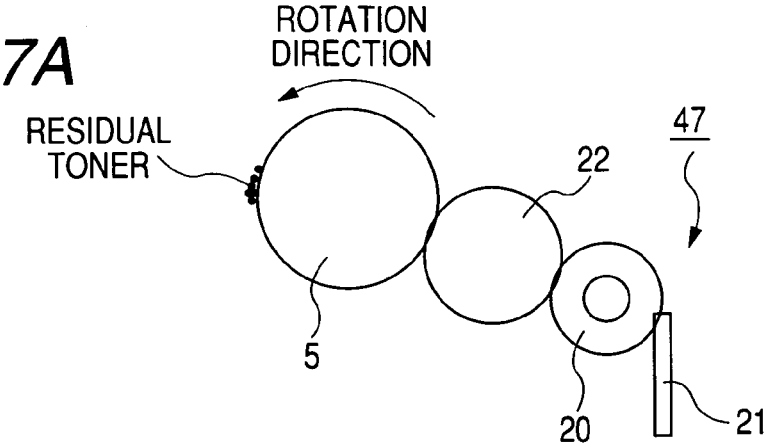
Figure 7B:
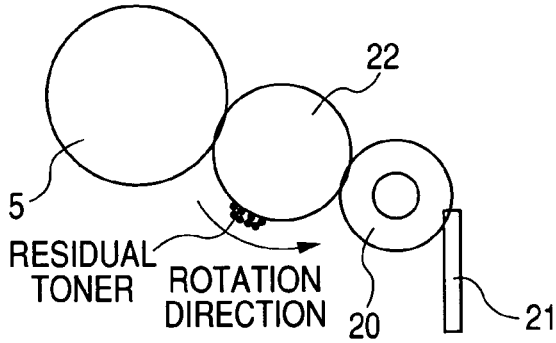
Figure 7C:
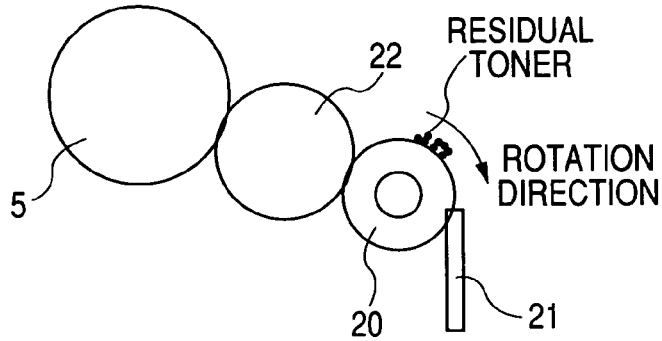
Figure 7D:
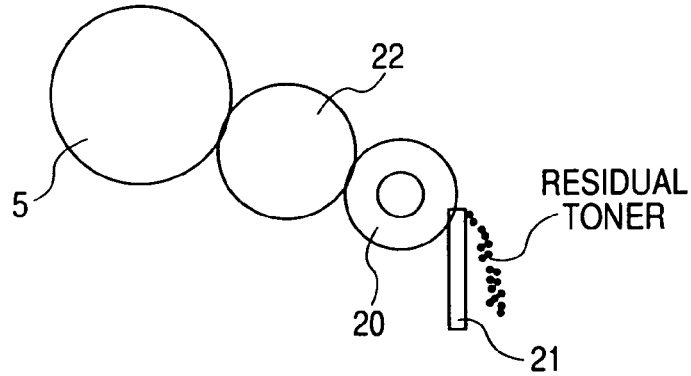
Figure 10:
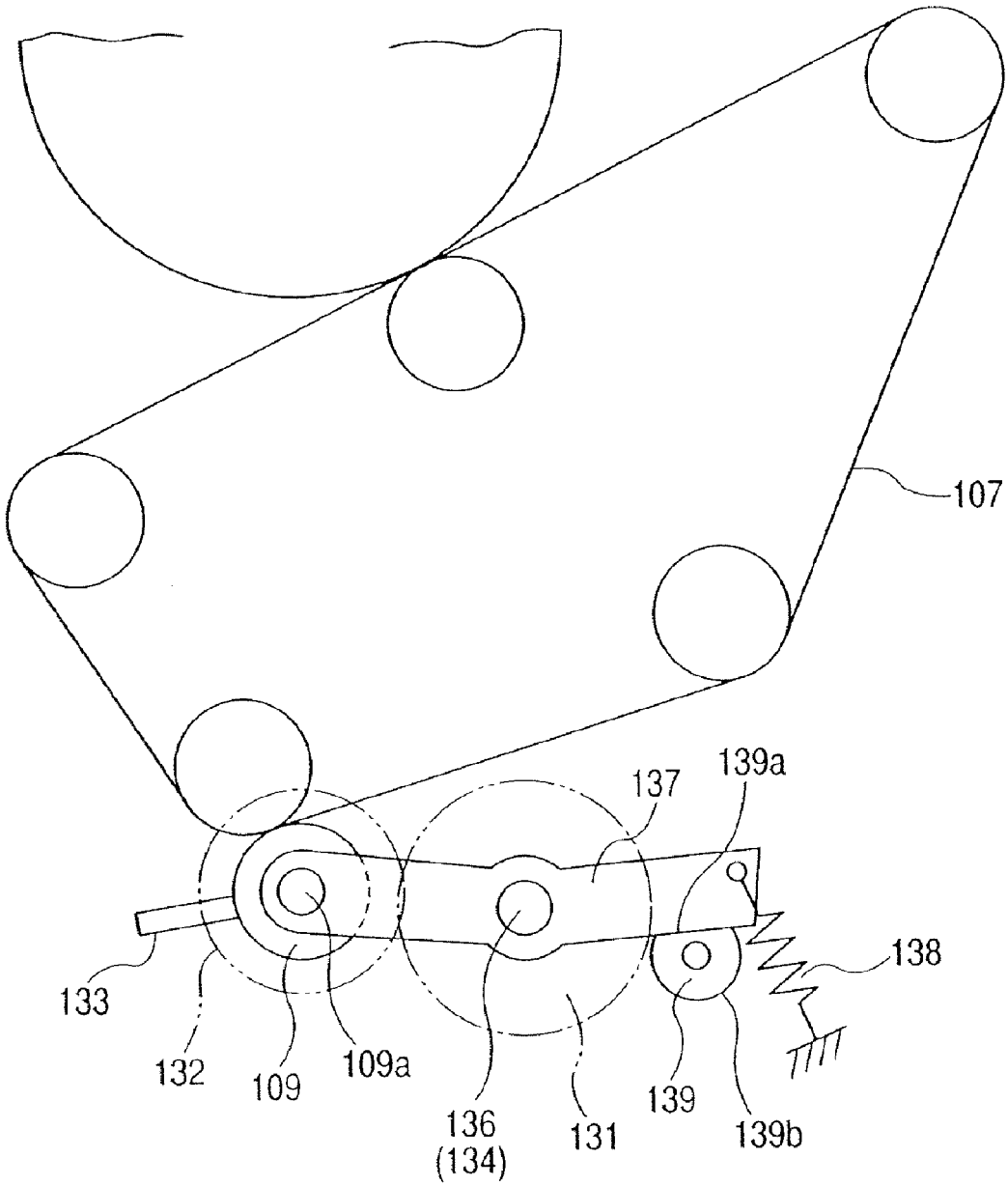
PRIOR ART FIG. 10
FIG. 10 is a front view of a main portion of a conventional image transferring apparatus.
Figure 11:
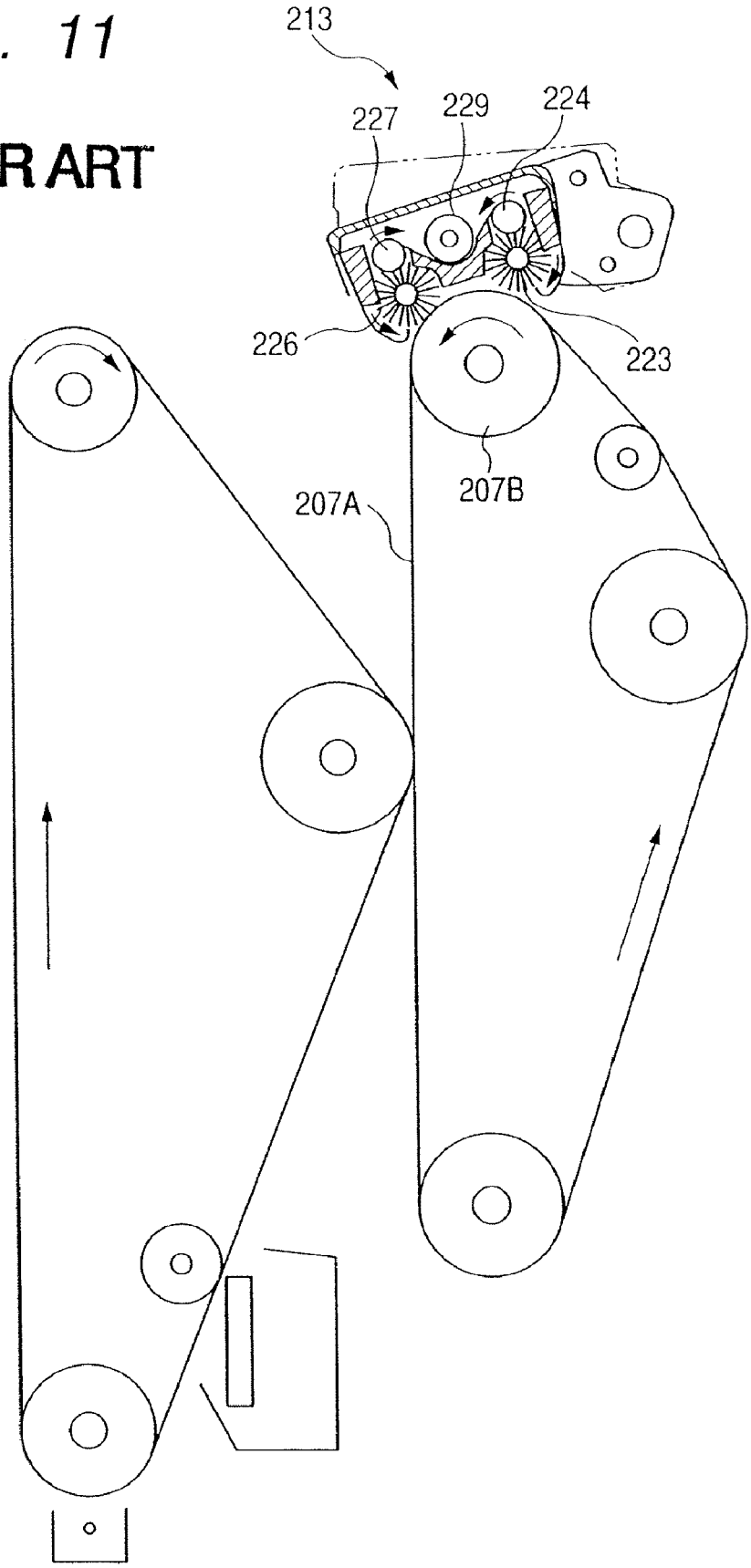
FIG. 11 PRIOR ART
FIG. 11 is a schematic front view of a conventional cleaning device.

The flow of the residual toner adhering to the electrostatic roller 20 is as shown in FIGS. 7A through 7D. The residual toner adhering to the secondary transferring outer roller 5 is first electrostatically collected by the fur brush 22 (FIGS. 7A and 7B). The residual toner is collected from the rotating fur brush 22 by the electrostatic roller 20 (FIG. 7C), and is scraped off from the electrostatic roller 20 by a scraping member 21 as the toner removing member (FIG. 7D) before being carried by a toner carrying means (not shown). It is also possible for the residual toner to be collected by a toner collecting portion installed substantially below the secondary transferring portion 41. Here, the scraping member 21 is in contact with the electrostatic roller 20, so that there is no need for the scraping member 21 itself to rock. Accordingly, it is possible to achieve an improvement in the positional accuracy of the scraping member 21. Further, the residual toner can be reliably removed.

Incidentally, a structure in which the secondary transferring outer roller 5 is made at least one rotation while the secondary transferring outer roller 5 rocks, in order to perform surely cleaning for the toner adhering on the secondary transferring outer roller 5, can be employed.

The present invention is not restricted to the above construction. For example, as in the case of a residual toner removal apparatus 48 shown in FIG. 8, it is also possible to scrape off residual toner adhering to the fur brush 22 which is contact with the secondary transfeffing outer roller 5 by a toner scraping member 32. In this case, the secondary transfeffing outer roller 5 rocks using the fur brush 22 as the fulcrum, and cleaning is effected on the secondary transferring outer roller 5 by applying to the fur brush 22 a bias voltage of a polarity reverse to that of the residual toner on the second transferring outer roller 5. In this embodiment, the fur brush 22 serves as the toner collecting rotary member.

This application claims priority from Japanese Patent Application No. 2004-131473 filed on Apr. 27, 2004, which is hereby incorporated by reference herein.

What is claimed is:

1. An image forming apparatus comprising:

an image bearing member that rotates while bearing toner image;

a unit that integrally includes:

a transfer member that rotates while contacting with the image bearing member and electrostatically transfers the toner image on the image bearing member to a recording material, a toner removing member that rotates while contacting with the transfer member, and electrostatically collects the toner on the transfer member, and an electrode member that rotates and contacts with the toner removing member while a voltage is applied;

a rocking unit that rocks the transfer member around a rotational center of the electrode member so that the transfer member is separated from and contacted with the image bearing member; and a rotational unit that rotates the transfer member, the toner removing member, and the electrode member so that the toner removing member collects toner on the transfer member, when the transfer member is separated from and contacted with the image bearing member.

2. An image forming apparatus according to claim 1, wherein the toner removing member includes a brush.

* * * * *

UNITED STATES PATENT AND TRADEMARK OFFICE

CERTIFICATE OF CORRECTION

PATENT NO. : 7,242,886 B2
APPLICATION NO. : 11/109721
DATED : July 10, 2007
INVENTOR(S) : Yuhei Takei It is certified that error appears in the above-identified patent and that said Letters Patent is hereby corrected as shown below:

ON THE TITLE PAGE:

At Item (56), FOREIGN PATENT DOCUMENTS, "0799603 A," should read --07-99603 A,-- and "2000075571 A," should read --2000-075571 A--.

At Item (57), ABSTRACT, Line 2, "toner" should read --a toner-- and at Lines 9 and 10, "by that" should read --while--.

COLUMN 2:

Lines 52 and 53, "by that" should read --while--.

COLUMN 3:

Line 34, "a fur," should read --a fur brush,--.

COLUMN 4:

Line 46, "an yellow" should read --a yellow--.

COLUMN 7:

Line 3, "transfeffing" should read --transferring--;
Line 4, "transfeffing" should read --transferring--;
Line 7, "transfeffing" should read --transferring--; and
Line 28, "is made" should read --makes--.

COLUMN 8:

Line 1, "transfeffing" should read --transferring--.

Signed and Sealed this

Eleventh Day of March, 2008

JON W. DUDAS
*Director of the United States Patent and Trademark Office*